US009528798B1

(12) United States Patent
Hodge, Jr.

(10) Patent No.: US 9,528,798 B1
(45) Date of Patent: Dec. 27, 2016

(54) PORTABLE AND MODULAR FIREARM TARGET STAND

(71) Applicant: James C. Hodge, Jr., Nassau, NY (US)

(72) Inventor: James C. Hodge, Jr., Nassau, NY (US)

( * ) Notice: Subject to any disclaimer, the term of this patent is extended or adjusted under 35 U.S.C. 154(b) by 70 days.

(21) Appl. No.: 14/533,574

(22) Filed: Nov. 5, 2014

Related U.S. Application Data

(60) Provisional application No. 61/944,750, filed on Feb. 26, 2014.

(51) Int. Cl.
*F41J 1/10* (2006.01)
*F16M 11/22* (2006.01)
*F16M 11/16* (2006.01)

(52) U.S. Cl.
CPC ..... *F41J 1/10* (2013.01); *F16M 11/16* (2013.01); *F16M 11/22* (2013.01)

(58) Field of Classification Search
CPC ..... A63B 67/06; F41J 1/10; F41J 3/00; F41J 3/0004
USPC ..... 273/398–408, 390–392
See application file for complete search history.

(56) References Cited

U.S. PATENT DOCUMENTS 507,098 A * 10/1893 Bates ..... A63B 67/06 273/401
2,372,111 A * 3/1945 Norberg ..... F41J 1/10 160/201
2,722,420 A 11/1955 Adamson
2,899,204 A 8/1959 Ratay
3,094,802 A 6/1963 Perry
3,415,519 A * 12/1968 Hand ..... F41J 1/10 248/170
3,540,729 A * 11/1970 Rahberger ..... F41J 1/10 248/156
4,029,318 A * 6/1977 Boss ..... F41J 1/10 108/118
4,054,288 A * 10/1977 Perrine, Sr. ..... F41J 3/0004 273/407
4,189,146 A * 2/1980 Warner ..... F41J 3/0004 273/407
4,254,952 A 3/1981 Playter, Jr.
4,629,188 A 12/1986 Mahieu
5,209,492 A 5/1993 Hamilton
5,441,267 A * 8/1995 Alder ..... G09F 17/00 116/173
5,513,843 A 5/1996 Russell
5,531,656 A 7/1996 Varghese
5,671,924 A 9/1997 Scott
5,692,979 A * 12/1997 Jones ..... A63B 67/04 273/400
5,725,217 A 3/1998 White
5,860,654 A * 1/1999 Jacobs ..... F41J 1/10 273/407
5,938,203 A * 8/1999 Beckwith, Sr. ..... F41J 1/10 273/407

(Continued)

*Primary Examiner* — Mark Graham
(74) *Attorney, Agent, or Firm* — Robert C. Montgomery; Montgomery Patent & Design LP.

(57) ABSTRACT

A portable modular target holding apparatus includes a base section, a pair of vertical support sections, each vertical support section of the pair of vertical support sections being connected to the base section, and a pair of target windows, each target window of the pair of target windows being connected to a respective vertical support section of the pair of vertical support sections. A target is removably connected to the each target window.

16 Claims, 3 Drawing Sheets

(56) References Cited

U.S. PATENT DOCUMENTS

| | | | | |
|---|---|---|---|---|
| 5,954,337 | A * | 9/1999 | Cunningham | A63B 67/06 273/338 |
| 5,967,523 | A * | 10/1999 | Brownlee | F41J 1/10 273/407 |
| 6,761,357 | B2 | 7/2004 | Witt et al. | |
| 7,338,048 | B1 * | 3/2008 | Hulstine | F41J 1/10 211/196 |
| 7,644,927 | B2 | 1/2010 | Law | |
| 7,726,657 | B2 | 6/2010 | Shalosky | |
| 7,845,646 | B1 | 12/2010 | Weber | |
| 2010/0194048 | A1 * | 8/2010 | Medina | F41J 1/10 273/407 |
| 2012/0068412 | A1 | 3/2012 | Diercks | |
| 2013/0269193 | A1 * | 10/2013 | Eckhart | F41J 3/0004 33/228 |
| 2015/0069709 | A1 * | 3/2015 | Doria | F41J 1/10 273/407 |

* cited by examiner

PORTABLE AND MODULAR FIREARM TARGET STAND

RELATED APPLICATIONS

The present invention was first described in and claims the benefit of U.S. Provisional Application No. 61/944,750, filed Feb. 26, 2014, the entire disclosures of which are incorporated herein by reference.

FIELD OF THE INVENTION

The present invention relates generally to firearm targets and, more particularly, to a portable and modular stand for firearm targets.

BACKGROUND OF THE INVENTION

Handgun and rifle target shooting is enjoyed by a large number of sport enthusiasts. In such cases where this target shooting occurs outdoors, targets are typically held in place by large fixed location target holders.

While functional, such holders are usually fixed in one (1) location and may not be suitable for those wishing to practice at shorter or longer distances. Additionally, such target holders are often broken, missing components, or only accept certain types of targets. Those who are in rural locations wishing to practice on their private property often assembly makeshift targets that move during use or are at non-optimal angles or heights. Should one build their own target holders, they usually become fixed in place and must remain outside in inclement weather where they fail and become unusable in only a short manner of time.

Accordingly, there exists a need for a means by which handgun and rifle targets can be supported and used in an outdoor environment without the disadvantages as described above.

SUMMARY OF THE INVENTION

The inventor has recognized the aforementioned inherent problems and lack in the art and observed that there is a need for a portable collapsible modular dual target holding apparatus. The development of the present invention, which will be described in greater detail herein, substantially departs from conventional solutions to fulfill this need.

In one (1) embodiment, the disclosed portable modular target holding apparatus includes a base section, a vertical support section connected to the base section, and a target window connected to the vertical support section. A target is removably connected to the target window.

In another embodiment, the disclosed portable modular target holding apparatus includes a base section, a pair of vertical support sections, each vertical support section of the pair of vertical support sections being connected to the base section, and a pair of target windows, each target window of the pair of target windows being connected to a respective vertical support section of the pair of vertical support sections. A target is removably connected to the each target window.

In yet another embodiment, the disclosed portable modular target holding apparatus includes an X-fitting including a first receiving end, a second receiving end, a third receiving end, and a fourth receiving end. The first receiving end, the second receiving end, the third receiving end, and the fourth receiving end being disposed perpendicularly to one (1) another. The apparatus includes a first leg assembly including a first end connected to the first receiving end of the X-fitting and an opposed second end. The apparatus includes a second leg assembly including a first end connected to the second receiving end of the X-fitting and an opposed second end. The apparatus includes a third leg assembly including a first end connected to the third receiving end of the X-fitting and an opposed second end. The apparatus includes a fourth leg assembly including a first end connected to the fourth receiving end of the X-fitting and an opposed second end. The apparatus includes a first end cap connected to the second end of the first leg assembly. The apparatus includes a second end cap connected to the second end of the second leg assembly. The apparatus includes a first ninety degree (90°) fitting including a first receiving end connected to the second end of the third leg assembly and an opposed second receiving end, the first receiving end and the second receiving end of the first ninety degree (90°) fitting being disposed perpendicularly to one (1) another. The apparatus includes a first leg stand including a lower end connected to the second receiving end of the first ninety degree (90°) fitting and an opposed upper end. The apparatus includes a first Y-fitting including a first lower receiving end connected to the upper end of the first leg stand, a second lower receiving end disposed at an acute angle relative to the first lower receiving end, and an upper receiving end opposite the first lower receiving end and the second lower receiving end. The apparatus includes a first rear leg support including an upper end connected to the second lower receiving end of the first Y-fitting and an opposed second end. The apparatus includes a third end cap connected to the lower end of the first rear leg support. The apparatus includes a second ninety degree (90°) fitting including a first receiving end connected to the second end of the fourth leg assembly and an opposed second receiving end, the first receiving end and the second receiving end of the second ninety degree (90°) fitting being disposed perpendicularly to one (1) another. The apparatus includes a second leg stand including a lower end connected to the second receiving end of the second ninety degree (90°) fitting and an opposed upper end. The apparatus includes a second Y-fitting including a first lower receiving end connected to the upper end of the second leg stand, a second lower receiving end disposed at an acute angle relative to the first lower receiving end, and an upper receiving end opposite the first lower receiving end and the second lower receiving end. The apparatus includes a second rear leg support including an upper end connected to the second lower receiving end of the second Y-fitting and an opposed second end. The apparatus includes a fourth end cap connected to the lower end of the second rear leg support. The apparatus includes a first T-fitting including a lower end connected to the upper receiving end of the first Y-fitting, a first receiving end disposed perpendicularly to the lower end, and a second receiving end disposed perpendicularly to the lower end and opposite the first receiving end. The apparatus includes a first short tubing section including a first end connected to the first receiving end of the first T-fitting and an opposed second end. The apparatus includes a second short tubing section including a first end connected to the second receiving end of the first T-fitting and an opposed second end. The apparatus includes a third ninety degree fitting including a first receiving end connected to the second end of the first short tubing section and an opposed second receiving end, the first receiving end and the second receiving end of the third ninety degree (90°) fitting being disposed perpendicularly to one (1) another. The apparatus includes a fourth ninety degree (90°) fitting including a first receiving end connected to the second end of the second short tubing section and an opposed second receiving end, the first receiving end and the second receiving end of the fourth ninety degree (90°) fitting being disposed perpendicularly to one another. The apparatus includes a first side elongated tubing section including a first end connected to the second receiving end of the third ninety degree (90°) fitting and an opposed second end. The apparatus includes a second side elongated tubing section including a first end connected to the second receiving end of the fourth ninety degree (90°) fitting and an opposed second end. The apparatus includes a fifth ninety degree (90°) fitting including a first receiving end connected to the second end of the first side elongated tubing section and an opposed second receiving end, the first receiving end and the second receiving end of the fifth ninety degree (90°) fitting being disposed perpendicularly to one (1) another. The apparatus includes a sixth ninety degree (90°) fitting including a first receiving end connected to the second end of the second side elongated tubing section and an opposed second receiving end, the first receiving end and the second receiving end of the sixth ninety degree (90°) fitting being disposed perpendicularly to one (1) another. The apparatus includes a first top elongated tubing section including a first end connected to the second receiving end of the fifth ninety degree (90°) fitting and an opposed second end connected to the second receiving end of the sixth ninety degree (90°) fitting. The apparatus includes a first upper eyebolt connected to the first side elongated tubing section near the second end of the first side elongated tubing section. The apparatus includes a first lower eyebolt connected to the first side elongated tubing near the first end of the first elongated tubing section. The apparatus includes a second upper eyebolt connected to the second side elongated tubing section near the second end of the second side elongated tubing section. The apparatus includes a second lower eyebolt connected to the second side elongated tubing near the first end of the second elongated tubing section. The apparatus includes a first upper elastic line including a first hook assembly removably connected to the first upper eyebolt and an opposed second hook assembly removably connected to the second upper eyebolt. The apparatus includes a first lower elastic line including a third hook assembly removably connected to the first lower eyebolt and an opposed fourth hook assembly removably connected to the second lower eyebolt. The apparatus includes a first pair of spring clips movably connected to the first upper elastic line. The apparatus includes a second pair of spring clips movably connected to the first lower elastic line. The apparatus includes a second T-fitting including a lower end connected to the upper receiving end of the second Y-fitting, a first receiving end disposed perpendicularly to the lower end, and a second receiving end disposed perpendicularly to the lower end and opposite the first receiving end. The apparatus includes a third short tubing section including a first end connected to the first receiving end of the second T-fitting and an opposed second end. The apparatus includes a fourth short tubing section including a first end connected to the second receiving end of the second T-fitting and an opposed second end. The apparatus includes a seventh ninety degree (90°) fitting including a first receiving end connected to the second end of the third short tubing section and an opposed second receiving end, the first receiving end and the second receiving end of the seventh ninety degree (90°) fitting being disposed perpendicularly to one (1) another. The apparatus includes an eighth ninety degree (90°) fitting including a first receiving end connected to the second end of the fourth short tubing section and an opposed second receiving end, the first receiving end and the second receiving end of the eighth ninety degree (90°) fitting being disposed perpendicularly to one another. The apparatus includes a third side elongated tubing section including a first end connected to the second receiving end of the seventh ninety degree (90°) fitting and an opposed second end. The apparatus includes a fourth side elongated tubing section including a first end connected to the second receiving end of the eighth ninety degree (90°) fitting and an opposed second end. The apparatus includes a ninth ninety degree (90°) fitting including a first receiving end connected to the second end of the third side elongated tubing section and an opposed second receiving end, the first receiving end and the second receiving end of the ninth ninety degree (90°) fitting being disposed perpendicularly to one (1) another. The apparatus includes a tenth ninety degree (90°) fitting including a first receiving end connected to the second end of the fourth side elongated tubing section and an opposed second receiving end, the first receiving end and the second receiving end of the tenth ninety degree (90°) fitting being disposed perpendicularly to one (1) another. The apparatus includes a second top elongated tubing section including a first end connected to the second receiving end of the ninth ninety (90°) degree fitting and an opposed second end connected to the second receiving end of the tenth ninety degree (90°) fitting. The apparatus includes a third upper eyebolt connected to the third side elongated tubing section near the second end of the third side elongated tubing section. The apparatus includes a third lower eyebolt connected to the third side elongated tubing near the first end of the third elongated tubing section. The apparatus includes a fourth upper eyebolt connected to the fourth side elongated tubing section near the second end of the fourth side elongated tubing section. The apparatus includes a fourth lower eyebolt connected to the fourth side elongated tubing near the first end of the fourth elongated tubing section. The apparatus includes a second upper elastic line including a fifth hook assembly removably connected to the third upper eyebolt and an opposed sixth hook assembly removably connected to the fourth upper eyebolt. The apparatus includes a second lower elastic line including a seventh hook assembly removably connected to the fourth lower eyebolt and an opposed eighth hook assembly removably connected to the fourth lower eyebolt. The apparatus includes a third pair of spring clips movably connected to the second upper elastic line. The apparatus includes a fourth pair of spring clips movably connected to the second lower elastic line. The apparatus includes a first target removably connected between the first pair of spring clips and the second pair of spring clips. The apparatus includes a second target removably connected between the third pair of spring clips and the fourth pair of spring clips.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
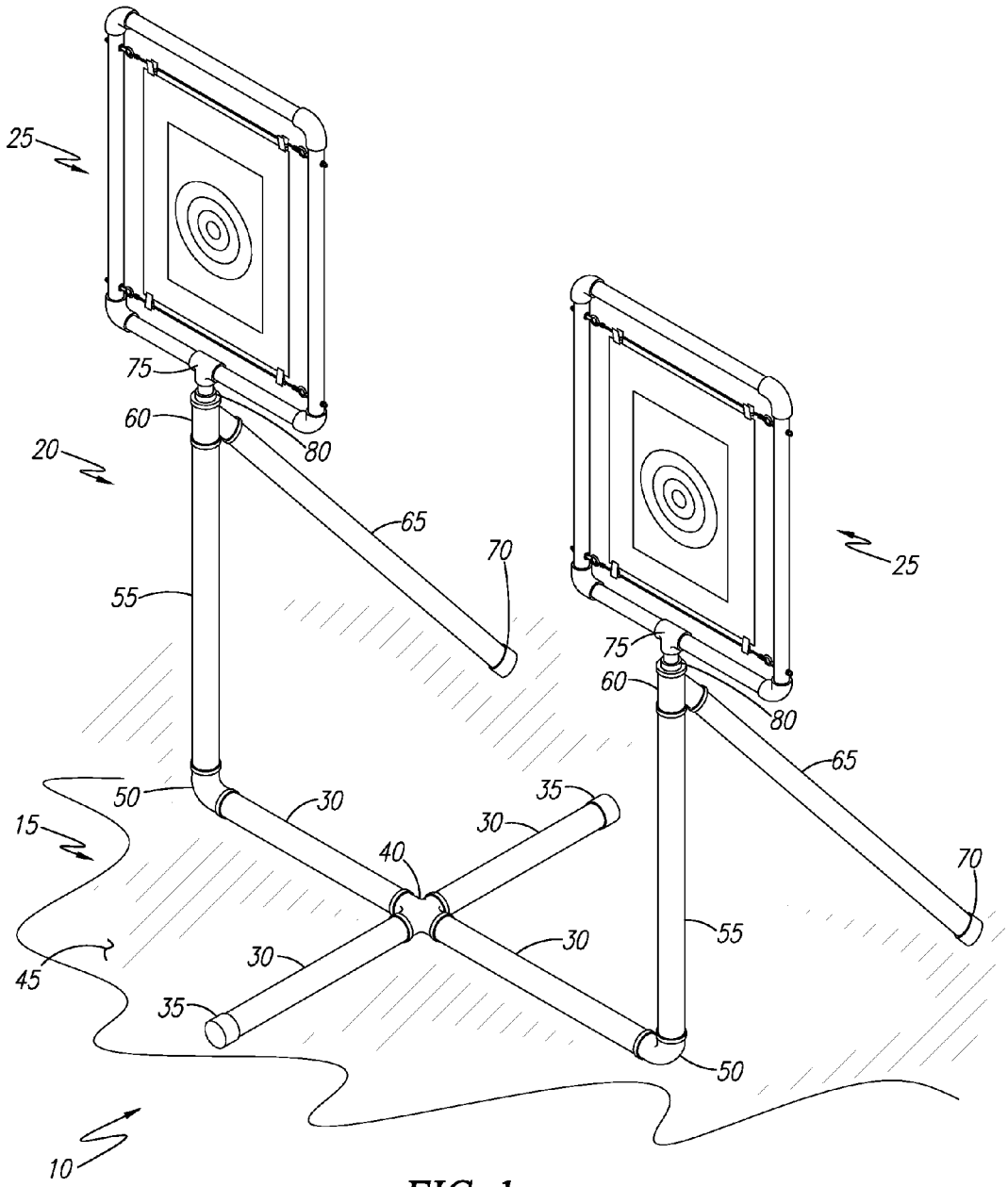
FIG. 1 is a perspective view of one embodiment of the disclosed portable collapsible modular dual target holding apparatus, shown in a ready to utilize state.

10 portable collapsible modular dual target holding apparatus
15 base section
20 vertical support section
25 target window
30 leg assembly
35 first end cap
40 X-fitting
45 suitable grade
50 first ninety degree (90°) elbows
55 leg stand
60 forty-five degree (45°) Y-fitting
65 rear leg support
70 second end cap
75 T-fitting
80 adapter
82 zippered elongated storage bag
85 short tubing sections
90 second ninety degree (90°) elbow
95 frame tubing sections
100 target
105 backing cardboard
110 elastic line
115 spring clip
120 hook assembly
125 eyebolt
130 hole
135 washer
140 nut

DETAILED DESCRIPTION OF THE PREFERRED EMBODIMENT

Figure 2:
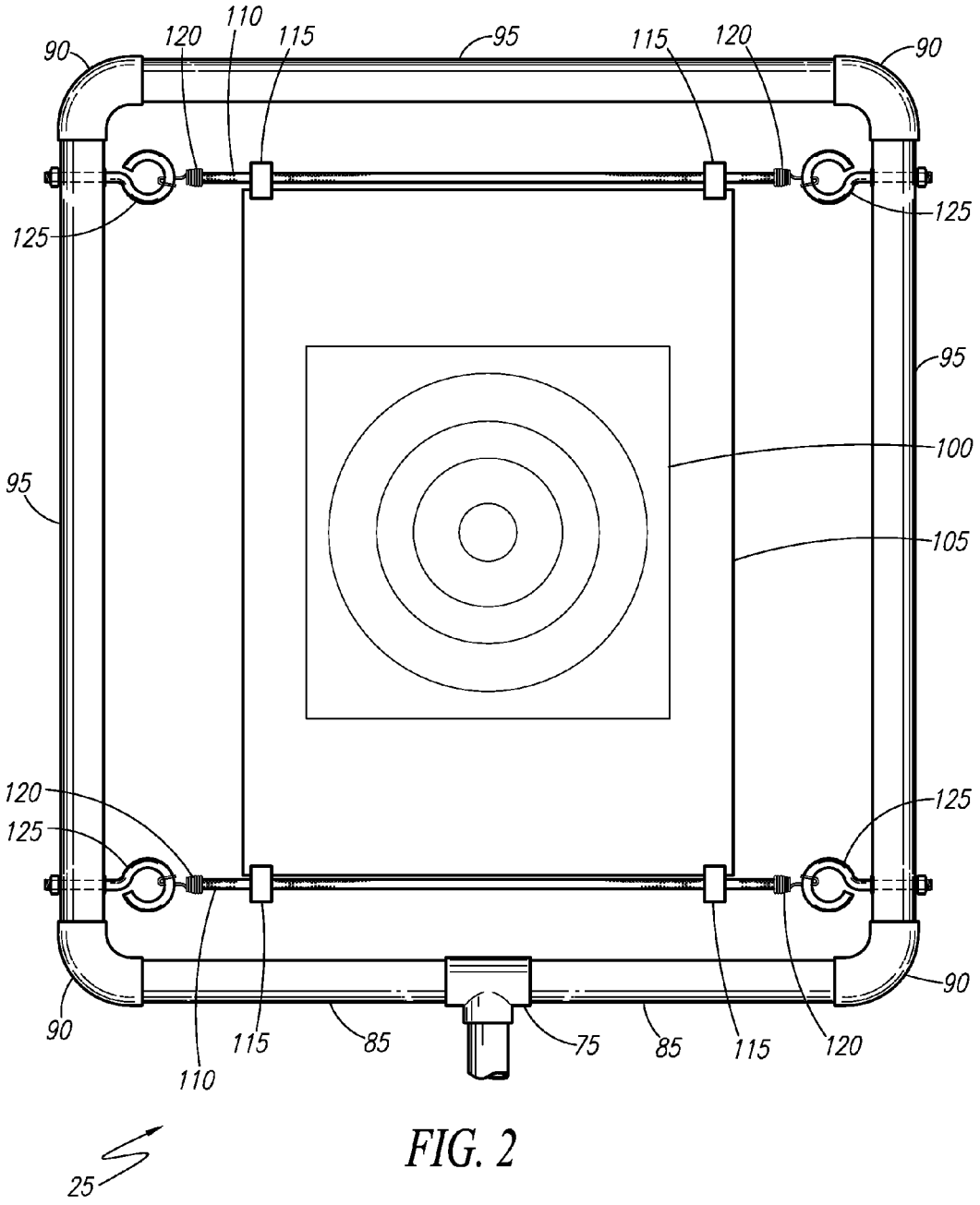
FIG. 2 is a front view of one (1) embodiment of the target window of the portable collapsible modular dual target holding apparatus; and, FIG. 3 is a partial view of the elastic lines used with the portable collapsible modular dual target holding apparatus.
Figure 3:
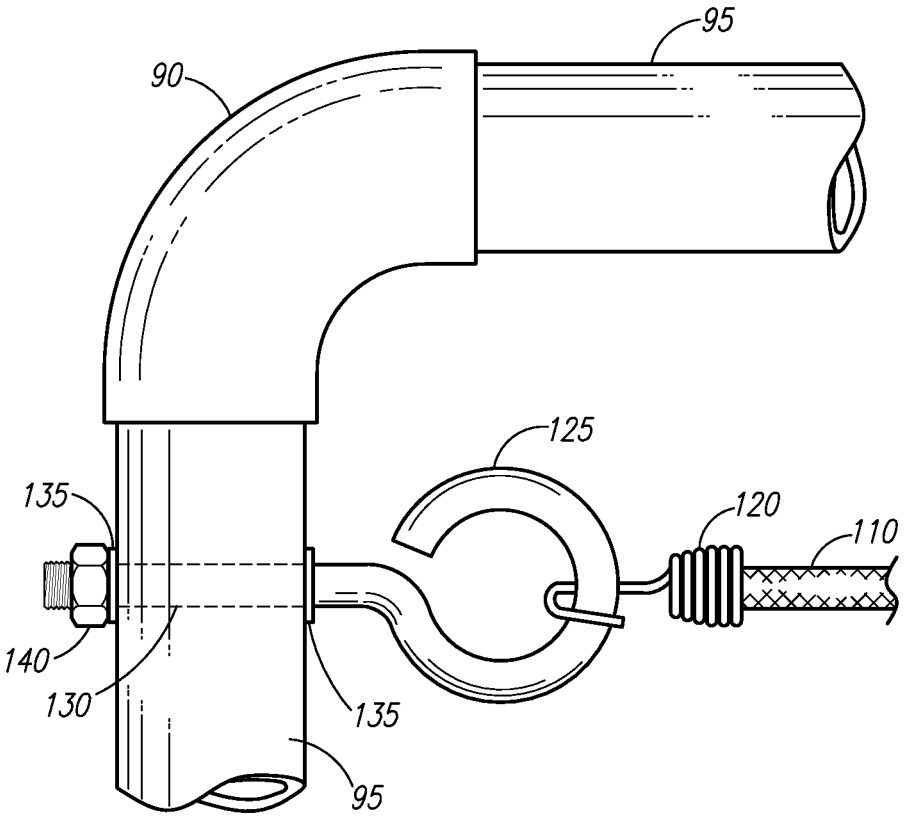

In accordance with the invention, the best mode is presented in terms of a one or more of the disclosed embodiments, herein depicted within FIGS. 1 through 3. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical" are used to describe a relationship of one (1) element, feature and/or region to another element, feature and/or region as illustrated in the figures.

Referring to FIGS. 1-3, disclosing a portable collapsible modular dual target holding apparatus (herein described as the "apparatus") 10, where like reference numerals represent similar or like parts.

Referring to FIG. 1, showing the apparatus 10 in a ready to utilize state, the apparatus 10 generally includes three (3) main components. The apparatus 10 includes a base section 15, a vertical support section 20, and at least one target window 25 (two target windows 25 are shown by example in FIG. 1).

In an example construction, all of the components are made from polyvinylchloride ("PVC") tubing of various lengths and diameters. While the overall dimensions of the apparatus 10, any single component (e.g., base section 15, a vertical support section 20, and at least one (1) target window 25), or sub-assembly or the components can vary, in an example construction, the size of the target windows 25 are approximately two square feet (2 $ft^2$), the height of the vertical support section 20 is approximately three-and-half feet (3½ ft.) tall, and the size of the base section 15 is approximately four feet (4 ft.) deep and four feet (4 ft.) wide. It should be noted that such dimensions along with the diameter of the tubing can vary per exact model or implementation of the disclosed apparatus 10, and is not intended to be a limiting factor.

The base section 15 includes four leg assemblies 30, two of which are provided with a permanently installed first end cap 35. At least one (1) leg assembly 30 is permanently connected into an X-fitting 40. Other connections are made by a friction fit connection that is removable to accommodate disassembly of the base section 15 and/or the apparatus 10 as a whole. In use, the base section 15 is suitably configured to sit flat upon suitable grade 45 (e.g., ground surface).

The vertical support section 20 includes at least one first ninety degree (90°) elbow 50 that supports a leg stand 55. The first ninety degree elbow 50 is connected to an end of at least one (1) of the leg assemblies 30, for example, one (1) of the two (2) leg assemblies 30 that does not terminate with the first end cap 35. In an example embodiment, as shown in FIG. 1, two (2) first ninety degree (90°) elbows 50 are connected to two (2) leg assemblies 30 and support two (2) leg stands 55.

Similar to the base section 15, some connections are made permanently, while others allow for disassembly. The appointment of which connections are permanent versus temporary can vary and are not intended as a limiting factor.

The upper end of the leg stand 55 includes with a forty-five degree (45°) Y-fitting 60 that connects to a rear leg support 65 (two (2) leg stands 55, two Y-fittings 60, and two (2) rear leg supports 65 are shown by example in FIG. 1). A second end cap 70 is connected to a lower end (e.g., a ground contacting end) of each rear leg supports 65.

An upper end of the forty-five degree (45°) Y-fitting 60 is connected to a T-fitting 75, for example, by use of an adapter 80. The target window 25 (two (2) target windows 25 are shown by example in FIG. 1) is connected to the T-fitting 75. It should be noted that all components of the apparatus 10 break down into generally linear pieces that store easily, for example, in a supplied zippered elongated storage bag (not shown) to simplify storage and transportation to and from target shooting practice areas.

Referring to FIG. 2, the target window 25 is connected to or includes the T-fitting 75. As an example construction, the target window 25 includes two (2) short tubing sections 85 connected to and extending from either side of the T-fitting 75. A second ninety degree (90°) elbow 90 is connected (e.g., permanently installed) to the end of each short tubing section 85. Two (2) additional second ninety degree (90°) elbows 90 along with three frame tubing sections 95 are connected to the second ninety degree (90°) elbows 90 to form (e.g., complete) a generally square-shaped assembly of the target window 25.

A target 100 is attached to the target window 25 within the square-shaped assembly. The target 100 is attached to a section of backing cardboard 105. The target 100 can be connected to or supported from the backing cardboard 105 in a customary and/or well-known manner. The backing cardboard 105 is supported by at least one (1) elastic line 110 using multiple spring clips 115. As an example construction and shown in FIGS. 1 and 2, two (2) opposed elastic lines 110 (e.g., an upper elastic line and a lower elastic line) are connected to the target window 25 and the target 100 and/or backing cardboard 105 is connected to and extends between the two (2) elastic lines 110.

At least one spring clip 115 is attached to the elastic line 110 and removably connected to the target 100 (e.g., to a peripheral edge of the target 100 and/or backing cardboard 105). As an example, two (2) spring clips 115 are shown in FIG. 2 as attached to each elastic line 100 and connected to the peripheral edge of the target 100 and/or backing cardboard 105 near upper and lower corners.

Referring to FIG. 3, each elastic lines 110 includes a hook assembly 120 on both ends (only one (1) end is shown in FIG. 3) to facilitate quick assembly and removal. The hook assembly 120 connects to an eyebolt 125. The eyebolt 125 is connected to the target window 25. In an example construction, the eyebolts 125 are connected through a hole 130 (e.g., through aperture) in each vertical frame tubing section 95. The eyebolt 125 is secured to the frame tubing sections 95 with two (2) opposing washers 135 and one (1) nut 140. In an example embodiment, two (1) eyebolts 125 (e.g., an upper eyebolt and a lower eyebolt) are connected to each frame tubing section 95.

The elastic nature of the elastic lines 110 allows for easy adjustment and replacement of the target 100 and/or backing cardboard 105. The eyebolt 125 remains permanently attached to the frame tubing sections 95 even when the apparatus 10 is disassembled.

Those skilled in the art will appreciate that the configuration shown and described in FIG. 3 is the same as and is repeated in each of the four corners of each target window 25.

Those skilled in the art will recognize that other styles and configurations of the disclosed apparatus 10 can be easily incorporated into the teachings of the present disclosure, and only particular configurations have been shown and described for purposes of clarity and disclosure and not by way of limitation of scope.

The disclosed embodiments of the apparatus 10 can be utilized by the common user in a simple and effortless manner with little or no training. After initial purchase or acquisition of the apparatus 10, it would be installed as illustrated in FIGS. 1-3.

In an example construction, the apparatus 10 can be manufactured according to the general teachings provided in FIGS. 1-3. The various tubular pieces can be cut to size according to a pattern. Should large scale production of the apparatus 10 be undertaken, suitable jigs and other assembly aids can be used to speed production and ensure consistency. After manufacture, several pieces can be permanently connected together using a solvent based adhesive. At this point in time the components of the apparatus 10 would be placed into the zippered elongated storage bag (not shown) along with suitable assembly and usage instructions for final sale to the end user.

Once purchased, the end user would transport the zippered elongated storage bag containing the apparatus 10 to the intended location of user. Final assembly would begin following the construction as detailed in FIGS. 1 and 2. The base section 15 would be assembled first using the leg assemblies 30, the first end cap 35 and the X-fitting 40. It would be set upon suitable grade 45 and construction would continue with the assembly of the vertical support section 20. The vertical support section 20 would utilize the first ninety degree (90°) elbows 50, the leg stands 55, the forty-five degree (45°) Y-fitting 60, the rear leg supports 65, the second end cap 70, the T-fitting 75 and the adapter 80. Finally, the two (2) target windows 25 would be assembled using the short tubing sections 85, the second ninety degree (90°) elbows 90, and the frame tubing sections 95. At this point in time the apparatus 10 is ready to support the target 100 and/or backing cardboard 105.

The target 100 would be attached to the backing cardboard 105 using tape, thumbtacks, or other suitable fastener in a customary manner. The backing cardboard 105 would then be connected to the two (2) sections of elastic lines 110 using the spring clips 115. At this point in time, the apparatus 10 is ready to be utilized.

The target windows 25 would be placed in a perpendicular manner to the shooter's line of sight when viewed from the top.

The skilled in the art will appreciate that the described embodiment of the apparatus 10 is suitable for use by one person who may shoot at either target 100 or two (2) shooters who shoot side by side at a respective target 100. The various targets 100 and/or the backing cardboard 105 would be replaced as needed following safe target shooting protocols. When finished with use, the apparatus 10 is disassembled in a reverse manner to that described above, and stored within the zippered elongated storage bag until needed again in a repeating fashion.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A portable modular target holding apparatus comprising:

a base section;

a vertical support section connected to said base section; and, a target window, comprising:

a T-fitting connected to said vertical support section;

an opposed pair of short tubing sections connected to said T-fitting;

an opposed pair of side elongated tubing sections connected to said pair of short tubing sections;

a top elongated tubing section connected to said pair of side elongated tubing sections;

an elastic line connected between said pair of side elongated tubing sections; and, a spring clip attached to said elastic line;

wherein a target is releasably connected to said spring clip; and, wherein said target is disposed between said pair of short tubing sections, said pair of side elongated tubing sections, and said top elongated tubing section.

2. The apparatus of claim 1, wherein said base section comprises four interconnected leg assemblies.

3. The apparatus of claim 2, wherein said base section further comprises an X-fitting connected to one end of each leg assembly of said four leg assemblies.

4. The apparatus of claim 3, wherein at least one leg assembly of said four leg assemblies is removably connected to said X-fitting.

5. The apparatus of claim 2, wherein each leg assembly of said four leg assemblies is disposed perpendicularly to an adjacent leg assembly of said four leg assemblies.

6. The apparatus of claim 2, wherein said base assembly further comprises an end cap connected to at least two leg assemblies of said four leg assemblies.

7. The apparatus of claim 1, wherein said vertical support section comprises a leg stand comprising a lower end connected to said base assembly and an opposed upper end;

wherein said target window is connected to said upper end of said leg stand.

8. The apparatus of claim 7, wherein said vertical support section further comprises a rear leg support comprising an upper end connected to said leg stand at said upper end of said leg stand and an opposed lower end.

9. The apparatus of claim 8, wherein said vertical support section further comprises an end cap connected to said lower end of said rear leg support.

10. A portable modular target holding apparatus comprising:

a base section;

a pair of vertical support sections, each vertical support section of said pair of vertical support sections being connected to said base section; and, a pair of target windows, each target window of said pair of target windows being connected to a respective vertical support section of said pair of vertical support sections and further comprising:

a T-fitting connected to said each vertical support section of said pair of vertical support sections;

an opposed pair of short tubing sections connected to said T-fitting;

an opposed pair of side elongated tubing sections connected to said pair of short tubing sections;

a top elongated tubing section connected to said pair of side elongated tubing sections;

a pair of elastic lines connected between said pair of side elongated tubing sections; and, a pair of spring clips movably attached to said elastic lines;

wherein a target is releasably connected to one of said spring clips; and, wherein said target is disposed between said pair of short tubing sections, said pair of side elongated tubing sections, and said top elongated tubing section.

11. The apparatus of claim 10, wherein said base section comprises:

four leg assemblies, each leg assembly comprising a first end and an opposed second end; and, an X-fitting connected to said first end of all of said four leg assemblies such that said each leg assembly of said four leg assemblies is disposed perpendicularly to an adjacent leg assembly of said four leg assemblies.

12. The apparatus of claim 11, wherein said base section further comprises an end cap connected to said second end of at least two leg assemblies of said four leg assemblies.

13. The apparatus of claim 10, wherein said each vertical support section of said pair of vertical support sections comprises:

a leg stand comprising a lower end connected to said base assembly and an opposed upper end; and, a rear leg support comprising an upper end connected to said leg stand at said upper end of said leg stand and an opposed lower end;

wherein said target window is connected to said upper end of said leg stand.

14. The apparatus of claim 13, wherein said each vertical support section of said pair of vertical support sections further comprises an end cap connected to said lower end of each rear leg support.

15. The apparatus of claim 10, further comprising a plurality of targets removably connected to said pair of target windows, each target of said plurality of targets comprising a backing cardboard.

16. A portable modular target holding apparatus comprising:

an X-fitting comprising a first receiving end, a second receiving end, a third receiving end, and a fourth receiving end, said first receiving end, said second receiving end, said third receiving end, and said fourth receiving end being disposed perpendicularly to one another;

a first leg assembly comprising a first end connected to said first receiving end of said X-fitting and an opposed second end;

a second leg assembly comprising a first end connected to said second receiving end of said X-fitting and an opposed second end;

a third leg assembly comprising a first end connected to said third receiving end of said X-fitting and an opposed second end;

a fourth leg assembly comprising a first end connected to said fourth receiving end of said X-fitting and an opposed second end;

a first end cap connected to said second end of said first leg assembly;

a second end cap connected to said second end of said second leg assembly;

a first ninety degree fitting comprising a first receiving end connected to said second end of said third leg assembly and an opposed second receiving end, said first receiving end and said second receiving end of said first ninety degree fitting being disposed perpendicularly to one another;

a first leg stand comprising a lower end connected to said second receiving end of said first ninety degree fitting and an opposed upper end;

a first Y-fitting comprising a first lower receiving end connected to said upper end of said first leg stand, a second lower receiving end disposed at an acute angle relative to said first lower receiving end, and an upper receiving end opposite said first lower receiving end and said second lower receiving end;

a first rear leg support comprising an upper end connected to said second lower receiving end of said first Y-fitting and an opposed second end;

a third end cap connected to said lower end of said first rear leg support;

a second ninety degree fitting comprising a first receiving end connected to said second end of said fourth leg assembly and an opposed second receiving end, said first receiving end and said second receiving end of said second ninety degree fitting being disposed perpendicularly to one another;

a second leg stand comprising a lower end connected to said second receiving end of said second ninety degree fitting and an opposed upper end;

a second Y-fitting comprising a first lower receiving end connected to said upper end of said second leg stand, a second lower receiving end disposed at an acute angle relative to said first lower receiving end, and an upper receiving end opposite said first lower receiving end and said second lower receiving end;

a second rear leg support comprising an upper end connected to said second lower receiving end of said second Y-fitting and an opposed second end;

a fourth end cap connected to said lower end of said second rear leg support;

a first T-fitting comprising a lower end connected to said upper receiving end of said first Y-fitting, a first receiving end disposed perpendicularly to said lower end, and a second receiving end disposed perpendicularly to said lower end and opposite said first receiving end;

a first short tubing section comprising a first end connected to said first receiving end of said first T-fitting and an opposed second end;

a second short tubing section comprising a first end connected to said second receiving end of said first T-fitting and an opposed second end;

a third ninety degree fitting comprising a first receiving end connected to said second end of said first short tubing section and an opposed second receiving end, said first receiving end and said second receiving end of said third ninety degree fitting being disposed perpendicularly to one another;

a fourth ninety degree fitting comprising a first receiving end connected to said second end of said second short tubing section and an opposed second receiving end, said first receiving end and said second receiving end of said fourth ninety degree fitting being disposed perpendicularly to one another;

a first side elongated tubing section comprising a first end connected to said second receiving end of said third ninety degree fitting and an opposed second end;

a second side elongated tubing section comprising a first end connected to said second receiving end of said fourth ninety degree fitting and an opposed second end;

a fifth ninety degree fitting comprising a first receiving end connected to said second end of said first side elongated tubing section and an opposed second receiving end, said first receiving end and said second receiving end of said fifth ninety degree fitting being disposed perpendicularly to one another;

a sixth ninety degree fitting comprising a first receiving end connected to said second end of said second side elongated tubing section and an opposed second receiving end, said first receiving end and said second receiving end of said sixth ninety degree fitting being disposed perpendicularly to one another;

a first top elongated tubing section comprising a first end connected to said second receiving end of said fifth ninety degree fitting and an opposed second end connected to said second receiving end of said sixth ninety degree fitting;

a first upper eyebolt connected to said first side elongated tubing section near said second end of said first side elongated tubing section;

a first lower eyebolt connected to said first side elongated tubing near said first end of said first elongated tubing section;

a second upper eyebolt connected to said second side elongated tubing section near said second end of said second side elongated tubing section;

a second lower eyebolt connected to said second side elongated tubing near said first end of said second elongated tubing section;

a first upper elastic line comprising a first hook assembly removably connected to said first upper eyebolt and an opposed second hook assembly removably connected to said second upper eyebolt;

a first lower elastic line comprising a third hook assembly removably connected to said first lower eyebolt and an opposed fourth hook assembly removably connected to said second lower eyebolt;

a first pair of spring clips movably connected to said first upper elastic line;

a second pair of spring clips movably connected to said first lower elastic line;

a second T-fitting comprising a lower end connected to said upper receiving end of said second Y-fitting, a first receiving end disposed perpendicularly to said lower end, and a second receiving end disposed perpendicularly to said lower end and opposite said first receiving end;

a third short tubing section comprising a first end connected to said first receiving end of said second T-fitting and an opposed second end;

a fourth short tubing section comprising a first end connected to said second receiving end of said second T-fitting and an opposed second end;

a seventh ninety degree fitting comprising a first receiving end connected to said second end of said third short tubing section and an opposed second receiving end, said first receiving end and said second receiving end of said seventh ninety degree fitting being disposed perpendicularly to one another;

an eighth ninety degree fitting comprising a first receiving end connected to said second end of said fourth short tubing section and an opposed second receiving end, said first receiving end and said second receiving end of said eighth ninety degree fitting being disposed perpendicularly to one another;

a third side elongated tubing section comprising a first end connected to said second receiving end of said seventh ninety degree fitting and an opposed second end;

a fourth side elongated tubing section comprising a first end connected to said second receiving end of said eighth ninety degree fitting and an opposed second end;

a ninth ninety degree fitting comprising a first receiving end connected to said second end of said third side elongated tubing section and an opposed second receiving end, said first receiving end and said second receiving end of said ninth ninety degree fitting being disposed perpendicularly to one another;

a tenth ninety degree fitting comprising a first receiving end connected to said second end of said fourth side elongated tubing section and an opposed second receiving end, said first receiving end and said second receiving end of said tenth ninety degree fitting being disposed perpendicularly to one another;

a second top elongated tubing section comprising a first end connected to said second receiving end of said ninth ninety degree fitting and an opposed second end connected to said second receiving end of said tenth ninety degree fitting;

a third upper eyebolt connected to said third side elongated tubing section near said second end of said third side elongated tubing section;

a third lower eyebolt connected to said third side elongated tubing near said first end of said third elongated tubing section;

a fourth upper eyebolt connected to said fourth side elongated tubing section near said second end of said fourth side elongated tubing section;

a fourth lower eyebolt connected to said fourth side elongated tubing near said first end of said fourth elongated tubing section;

a second upper elastic line comprising a fifth hook assembly removably connected to said third upper eyebolt and an opposed sixth hook assembly removably connected to said fourth upper eyebolt;

a second lower elastic line comprising a seventh hook assembly removably connected to said third lower eyebolt and an opposed eighth hook assembly removably connected to said fourth lower eyebolt;

a third pair of spring clips movably connected to said second upper elastic line;

a fourth pair of spring clips movably connected to said second lower elastic line;

a first target removably connected between said first pair of spring clips and said second pair of spring clips; and, a second target removably connected between said third pair of spring clips and said fourth pair of spring clips.

* * * * *